US010982437B2

(12) United States Patent
Lifshin et al.

(10) Patent No.: US 10,982,437 B2
(45) Date of Patent: Apr. 20, 2021

(54) MODULAR BARRIER DEVICE FOR A DOUBLE OCCUPANCY ROOM PARTITION

(71) Applicant: ChiCore Assets, LLC, Chicago, IL (US)

(72) Inventors: Marc Lifshin, Chicago, IL (US); Mitchell Dalton, Chicago, IL (US)

(73) Assignee: ChiCore Assets, LLC, Chicago, IL (US)

( * ) Notice: Subject to any disclaimer, the term of this patent is extended or adjusted under 35 U.S.C. 154(b) by 0 days.

(21) Appl. No.: 16/390,213

(22) Filed: Apr. 22, 2019

(65) Prior Publication Data

US 2020/0332521 A1 Oct. 22, 2020

(51) Int. Cl.

| | |
|---|---|
| ***E04B 2/74*** | (2006.01) |
| ***E06B 3/46*** | (2006.01) |
| ***A47B 47/00*** | (2006.01) |

(52) U.S. Cl.

CPC ..... *E04B 2/74* (2013.01); *A47B 47/0091* (2013.01); *E06B 3/4636* (2013.01)

(58) Field of Classification Search

CPC ..... E04B 2/74; E04B 2/827; E04B 1/34861; E06B 3/4636; B64D 11/0606; E04H 1/005

USPC ..... 52/380, 383, 378, 379, 238.1, 243.1, 29, 52/36.4, 36.5, 36.6, 39

See application file for complete search history.

(56) References Cited

U.S. PATENT DOCUMENTS 1,342,269 A * 6/1920 Stewart ..... A47B 43/02 312/258
2,660,269 A * 11/1953 Whitehouse ..... E04F 19/08 52/205
2,752,641 A * 7/1956 Robertson ..... E04B 2/74 52/143
2,790,209 A * 4/1957 Thompson ..... A47B 61/00 52/205
3,339,954 A * 9/1967 Alvden ..... F16B 25/0031 403/322.4
3,480,989 A * 12/1969 Edeus ..... E06B 3/4636 16/94 R
3,552,075 A * 1/1971 Crump ..... E04H 1/04 52/236.3
3,768,221 A * 10/1973 Fuller ..... E04B 1/003 52/220.2
4,048,767 A * 9/1977 Ferich ..... A47K 3/281 52/35
4,278,048 A * 7/1981 Klein ..... A01K 1/031 119/436
4,360,991 A * 11/1982 West ..... E04B 2/7416 312/286

(Continued)

*Primary Examiner* — Brent W Herring
(74) *Attorney, Agent, or Firm* — . Norvell IP, LLC

(57) ABSTRACT

A modular barrier device for partitioning a room into two separate living spaces comprising: a plurality of storage modules, said storage modules arranged in a side-by-side as a well as a back-to-back fashion, and adjacent to a door module, to create a closet module to define the two separate living spaces in the room; at least one door rail attached to the closet module; at least one barn-style door slidably attached to the at least one door rail to provide user access to at least one of the two separate living spaces; and an adjustable valence system, said adjustable valence system capable of attaching to the closet module and further capable of expanding to fill any gap between the top of the closet module and a room ceiling.

16 Claims, 9 Drawing Sheets

(56) References Cited

U.S. PATENT DOCUMENTS

| | | | | |
|---|---|---|---|---|
| 6,058,665 | A * | 5/2000 | Halvorson, Jr. | E05D 15/48 49/159 |
| 6,079,216 | A * | 6/2000 | de Marsillac Plunkett | A47G 29/20 109/7 |
| 7,707,790 | B2 * | 5/2010 | Williams | A47B 83/001 52/239 |
| 8,215,065 | B2 * | 7/2012 | Gallant | E04B 2/74 52/220.1 |
| 8,458,962 | B2 * | 6/2013 | Gallant | E04B 2/74 312/209 |
| 8,763,327 | B2 * | 7/2014 | Harter | E04B 2/74 160/222 |
| 9,109,375 | B2 * | 8/2015 | Martin | E04H 1/02 |
| 9,920,559 | B2 * | 3/2018 | Druckman | B64D 11/0606 |
| 10,428,540 | B1 * | 10/2019 | Werner | E04H 1/005 |
| 2009/0241438 | A1 * | 10/2009 | Gallant | E04B 2/74 52/36.5 |
| 2012/0272595 | A1 * | 11/2012 | Gallant | E04B 2/74 52/220.7 |
| 2013/0111835 | A1 * | 5/2013 | Harter | E04B 2/74 52/238.1 |
| 2016/0298370 | A1 * | 10/2016 | Druckman | B64D 11/0606 |
| 2017/0238701 | A1 * | 8/2017 | Ryner | A47B 47/0091 |
| 2019/0169899 | A1 * | 6/2019 | Miksza | E04B 2/827 |
| 2019/0186122 | A1 * | 6/2019 | Patterson | E04H 1/04 |

* cited by examiner

MODULAR BARRIER DEVICE FOR A DOUBLE OCCUPANCY ROOM PARTITION

FIELD

A method and apparatus for creating a modular barrier device for a double occupancy room partition is generally described.

BACKGROUND

In some embodiments, a modular barrier device for a double occupancy room divider (a/k/a "D.O. system") is a modular device used for dividing a single bedroom into two separate sleeping quarters (a/k/a bedrooms), affording occupants of each sub-divided room with a comfortable and private space. The D.O. system is comprised of back-to-back millwork closet components to create a primary partition structure, two lockable barn-style doors to close off the individual bedrooms and an expandable "valence" system to fill the cavity from the top of the primary partition structure to the finished ceiling, reducing light and sound transference between the individual bedrooms and living room. The objective of the invention is to use this modular harrier to create two distinct living spaces in a wide variety of rooms (e.g., from medium to large size) that previously would only hold one occupant, or would hold two or more occupants with little or no privacy.

The millwork closet system is designed using a limited number of primary standard-sized cabinet components, allowing the entire system to fit a multitude of different rooms, layouts and applications without significant redesign of the system as a whole. The modular components can be created from metal, wood, medium-density fiberboard ("MDF") and the like. Doors for closets and storage may be sliding doors similar to the barn-style door, fabric, hinged, or bi-fold and may be composed of laminate materials, slatted, or solid materials (including metal, wood, medium-density fiberboard (MDF) or frosted glass) and may be unadorned or may be covered with mirrors, cork board, dry erase boards and the like. They include storage spaces for clothes (both folded and hanging), shoes, laundry, books, accessories and the like comprising shelves, cabinets, cubbies, baskets and drawers. The modules are installed side-by-side and back-to-back, creating the primary structure on which the rest of the system is attached.

The barn-style doors are mounted on rails on each closet module within the bedrooms, allowing occupants to easily slide the door open and closed for additional privacy. The barn style doors have spring loaded wheels on the bottom and/or top of the door to provide stability across uneven floors or finish materials. The ham doors are keyed and lockable using magnetic hardware specific for sliding doors which use a magnetic catch and plunger to create a positive hold within a millwork jamb installed along the drywall at the inside of the room.

The expandable valence system is comprised of three components: 1) Header Fascia 2) Drop-In Ceiling and 3) Expandable Filler. The header fascia runs the length of the system on the inside of both bedrooms and closes the gaps between the top of the millwork closet system and the finished ceiling. The drop in ceiling eliminates light and sound from entering either bedroom from the shared vestibule and common living area. The expandable filler is made of compressed foam and insulation that fills the cavity between the top of the millwork closet system and the finished ceiling once deployed.

Typical room dimensions capable of accommodating this system vary from 9'-12' wide and 25'-30' deep, but the entry into the room should be centrally located and coordinated around the position of the shared vestibule.

Past methods and apparatus for creating a double occupancy room divider required high levels of customization of each piece, were expensive, and provided less function.

In view of the disadvantages associated with currently available methods and devices for a double occupancy room divider, there is a need for a device and method that reduce or eliminate such issues.

BRIEF DESCRIPTION

According to an aspect, the present embodiments may be associated with a modular barrier device for partitioning a room into two separate living spaces, comprising: a plurality of storage modules, said storage modules arranged in a side-by-side as a well as a hack-to-back fashion, and adjacent to a door module, to create a closet module to define the two separate living spaces in the room; at least one door rail attached to the closet module; at least one barn-style door slidably attached to the at least one door rail to provide user access to at least one of the two separate living spaces; and an adjustable valence system, said adjustable valence system capable of attaching to the closet module and further capable of expanding to fill any gap between the top of the closet module and a room ceiling in the room.

According to another aspect, the present embodiments may further comprise the modular barrier device for partitioning a room into two separate living spaces wherein the plurality of storage modules further comprised of at least one shelf, cubby, basket, drawer or closet rod.

According to yet another aspect the present embodiments may further comprise the modular barrier device for partitioning a room into two separate living spaces, wherein the plurality of storage modules further comprised of at least one storage door to enclose at least a portion of the storage modules.

According to still another aspect the present embodiments may further comprise the modular barrier device for partitioning a room into two separate living spaces, wherein the at least one storage door further comprises at least one storage sliding door, storage hinged door, storage bi-fold door or storage fabric door.

According to yet still another aspect the present embodiments may further comprise the modular barrier device for partitioning a room into two separate living spaces, wherein the at least one storage door is composed of metal, wood, medium density fiberboard, laminate, glass, or slats.

According to still yet another aspect the present embodiments may further comprise the modular barrier device for partitioning a room into two separate living spaces, wherein the at least one storage door further comprises at least one storage door covering composed of a storage door mirror covering, a storage door corkboard covering, or a storage door dry-erase board covering.

According to another aspect the present embodiments may further comprise the modular barrier device for partitioning a room into two separate living spaces, wherein the barn-style door slidably attached to the door rail to provide user access to at least one of the two separate living spaces further comprises a locking mechanism.

According to yet another aspect the present embodiments may further comprise the modular barrier device for partitioning a room into two separate living spaces, wherein the locking mechanism further comprises a magnetic lock.

According to still another aspect the present embodiments may further comprise the modular barrier device for partitioning a room into two separate living spaces, wherein the barn-style door slidably attached to the door rail to provide user access to at least one of the two separate living spaces further comprises at least one spring-loaded wheel attached to the barn-style door to provide stability for the barn-style door when the barn style door is slid open or closed across an uneven room floor.

According to yet still another aspect the present embodiments may further comprise the modular barrier device for partitioning a room into two separate living spaces, wherein the adjustable valence system further comprises a header fascia to cover any gap between the top of the primary room partition and the room ceiling in the room, a drop-in ceiling over a common area to reduce light and sound from the common area, and an expandable filler to fill a cavity defined by the closet module, the room ceiling in the room, the drop-in ceiling and the header fascia to further reduce light and sound transmission from the common area and between the two separate living spaces.

According to an aspect, the present embodiments may be associated with a modular barrier device for partitioning a room into two separate living spaces comprising: a plurality of storage modules, said storage modules arranged in a side-by-side as well as a back-to-back fashion and adjacent to a door module to create a closet module, to define the two separate living spaces, in the room, wherein said plurality of storage modules further consist of at least one shelf, cubby, basket, drawer or closet rod; said plurality of storage modules further consist of at least one storage door to enclose at least a portion of the storage modules; a door rail attached to the closet module; a barn-style door slidably attached to the door rail to provide user access to at least one of the two separate living spaces; said barn-style door further consists of a locking mechanism; said barn-style door further consists of at least one spring-loaded wheel attached to the barn-style door to provide stability for the barn-style door when the barn style door is slid open or closed across an uneven room floor; an adjustable valence system, said adjustable valence system capable of attaching to the closet module and further capable of expanding to fill any gap between the top of closet module and a room ceiling in the room; and said adjustable valence system further consists of a header fascia to fill any gap between the top of the closet module and the room ceiling in the room, a drop-in ceiling over a common area to reduce light and sound from the common area, and an expandable filler to fill a cavity defined by the closet module, the room ceiling in the room, the drop-in ceiling and the header fascia to further reduce light and sound transmission from the common area and between the two separate living spaces.

According to another aspect, the present embodiments may further comprise the modular barrier device for partitioning a room into two separate living spaces, wherein the at least one storage door further comprises at least one storage sliding door, storage hinged door, storage hi-fold door or storage fabric door.

According to yet another aspect, the present embodiments may further comprise the modular barrier device for partitioning a room into two separate living spaces, wherein the at least one storage door is composed of metal wood, medium density fiberboard, laminate, glass, or slats.

According to still another aspect, the present embodiments may further comprise the modular harrier device for partitioning a room into two separate living spaces, wherein the at least one door further comprises at least one storage door covering composed of a storage door mirror covering, a storage door corkboard covering, or a storage door dry-erase board covering.

According to yet still another aspect, the present embodiments may further comprise the modular barrier device for partitioning a room into two separate living spaces, wherein the locking mechanism further comprises a magnetic lock.

According to an aspect, the present embodiments may be associated with a modular barrier device for partitioning a room into two separate living spaces comprising: a plurality of storage modules, said storage modules arranged in a side-by-side as well as a back-to-back fashion and adjacent to a door module to create a closet module, to define the two separate living spaces, in the room, wherein said plurality of storage modules further consist of at least one shelf, cubby, basket, drawer or closet rod; said plurality of storage modules further consist of at least one storage door to enclose at least a portion of the storage cabinets; said at least one storage door further consist of at least one storage sliding door, storage hinged door, storage bi-fold door or storage fabric door; said at least one storage door is composed of metal, wood, medium density fiberboard, laminate, glass, or slats; said at least one storage door further consists of at least one storage door covering composed of a storage door mirror covering, a storage door corkboard covering, or a storage door dry-erase board covering; a door rail attached to the closet module; a barn-style door slidably attached to the door rail to provide user access to at least one of the two separate living spaces; said barn-style door further consists of a locking mechanism; said locking mechanism further consists of a magnetic lock; said barn-style door further consists of at least one spring-loaded wheel attached to the barn-style door to provide stability for the barn-style door when the barn style door is slid open or closed across an uneven room floor; an adjustable valence system, said adjustable valence system capable of attaching to the closet module and further capable of expanding to fill any gap between the top of the closet module and a room ceiling in the room; and said adjustable valence system further consists of a header fascia to fill any gap between the top of the closet module and the room ceiling in the room, a drop-in ceiling over a common area to reduce light and sound from the common area, and an expandable filler to till a cavity defined by the closet module, the room ceiling in the room, the drop-in ceiling and the header fascia to further reduce light and sound transmission from the common area and between the two separate living spaces.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

For purposes of illustrating features of the embodiments, a simple example will now be introduced and referenced throughout the disclosure. Those skilled in the an will recognize that this example is illustrative and not limiting and is provided purely for explanatory purposes. In the illustrative example and as seen in FIGS. 1-9 a modular barrier device 100 for partitioning a room 101 into two separate living spaces 102 and 104 is shown.

Figure 1:
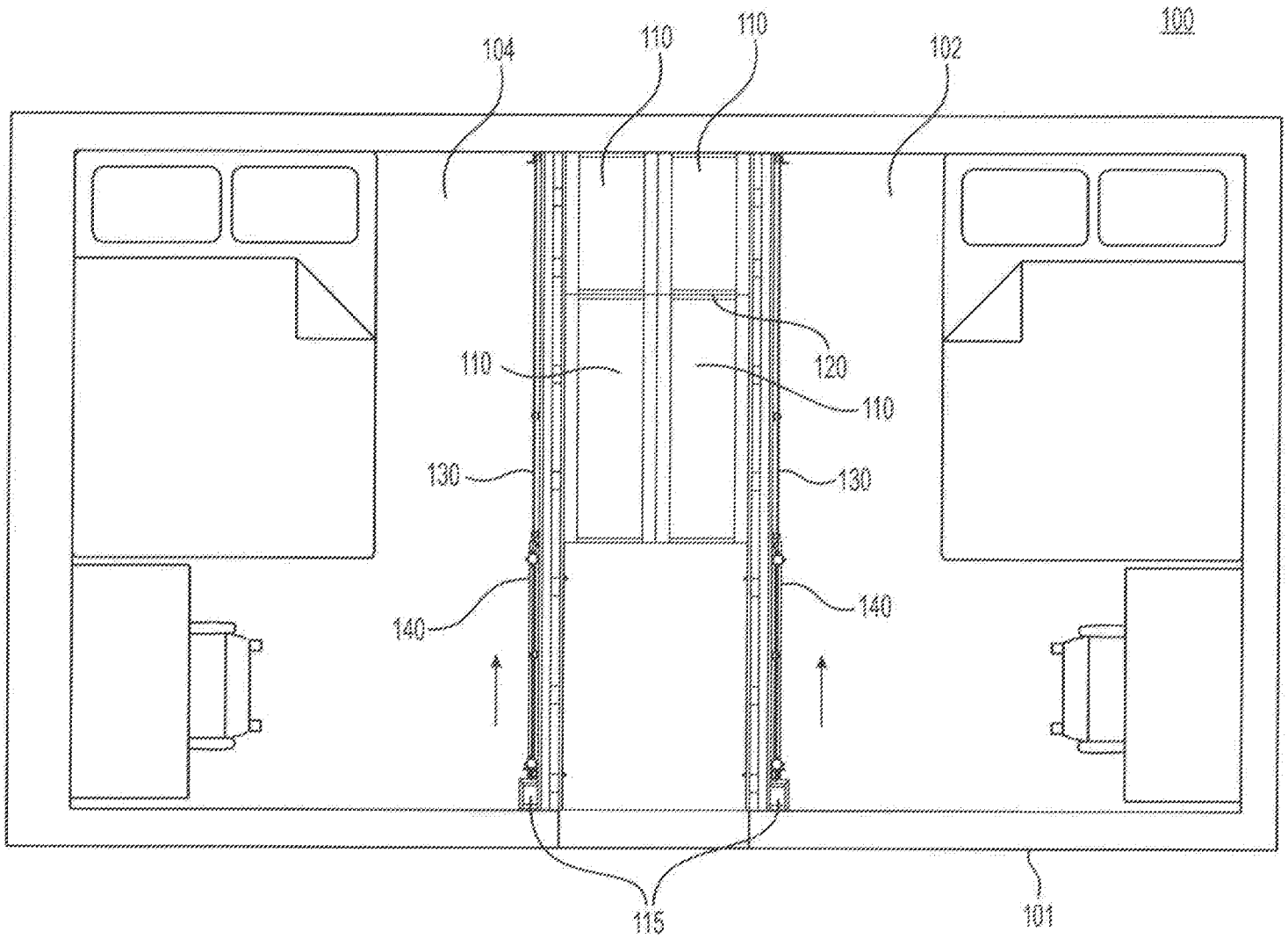
FIG. 1 is a plan view of a modular barrier device for partitioning a room into two separate living spaces according to an embodiment.

Turning now to FIG. 1, a plan view is provided that illustrates an embodiment of a modular barrier device 100, for partitioning a room 101, into two separate living spaces 102 and 104. FIG. 1 shows a plurality storage modules 110, and a door module 115, assembled together to create a closet module 120. The closet module 120, is also shown with door rails 130, and barn-style doors 140, attached to create a modular barrier device 100. The barn style doors 140, are shown in the closed position with the arrows indicating the direction of travel for the barn-style doors 140 to move into the open position.

Figure 2:
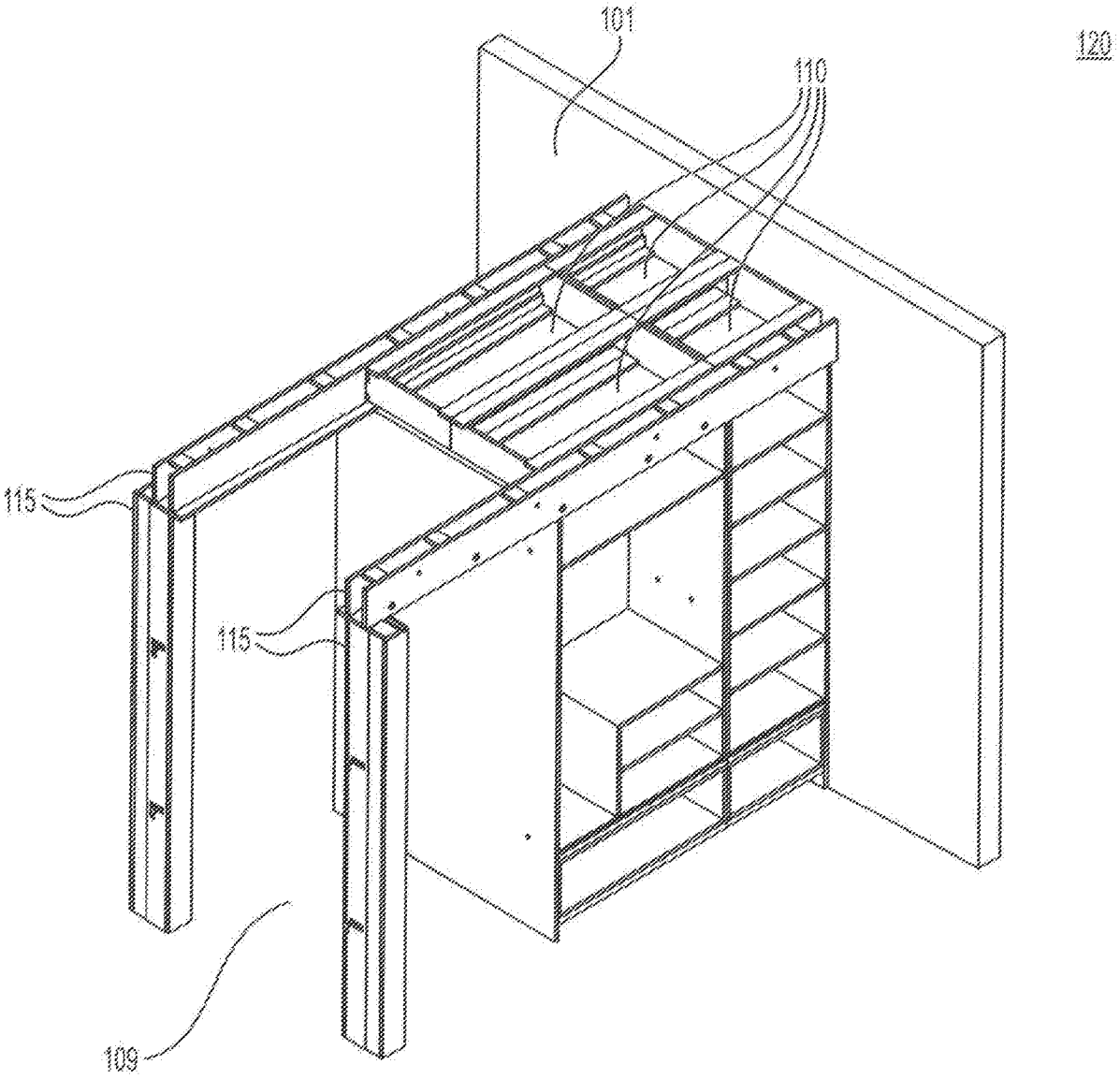
FIG. 2 is a perspective view of a closet module portion of a modular barrier device for partitioning a room into two separate living spaces according to an embodiment.

Turning now to FIG. 2, a perspective view is provided that illustrates an embodiment of a closet module 120, which is shown in a portion of a room 101. A plurality of storage modules 110, and a door module 115, are shown assembled into a closet module 120, thereby creating a common area 109.

Figure 3:
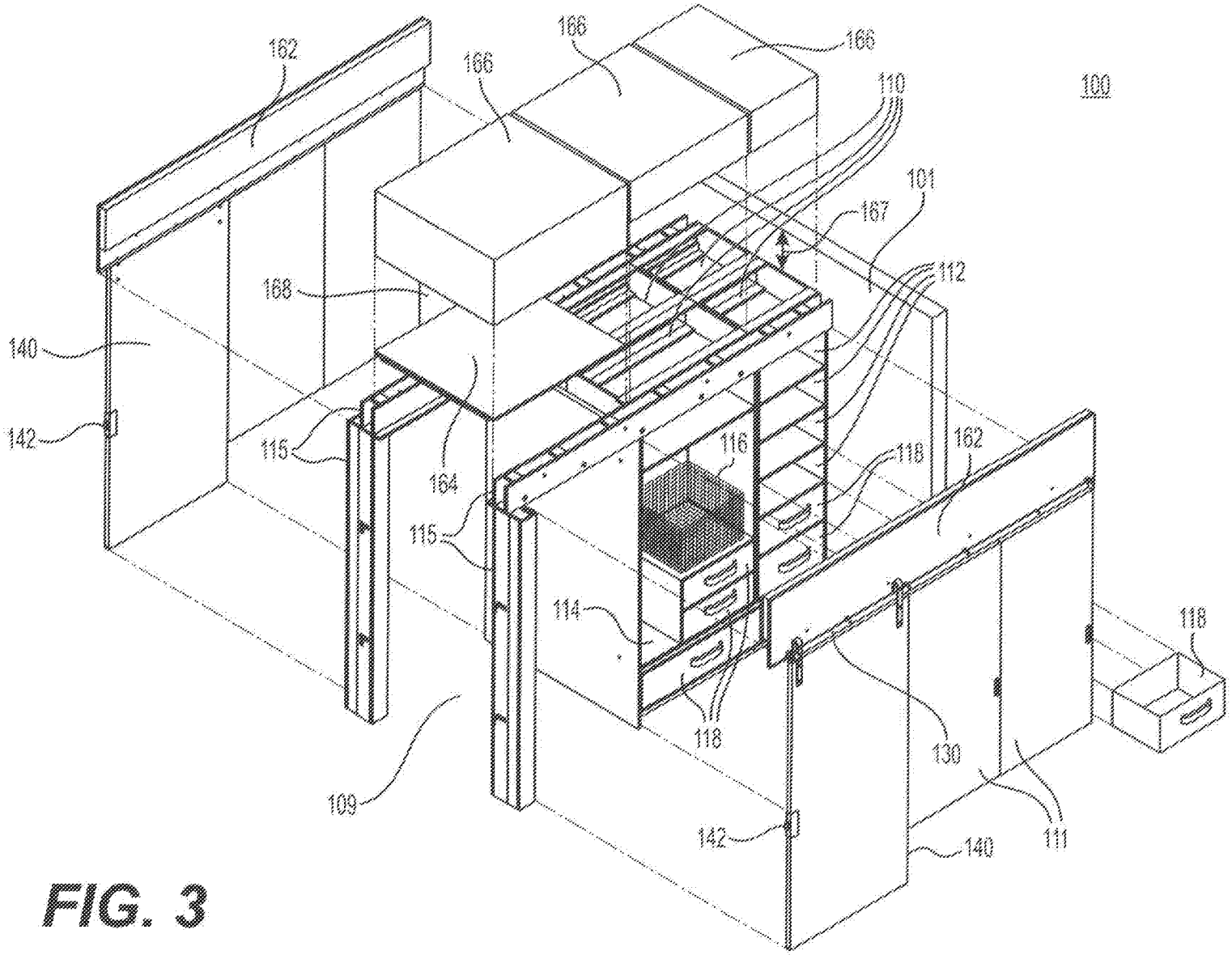
FIG. 3 is an exploded perspective view of a modular barrier device for partitioning a room into two separate living spaces according to an embodiment.

Turning now to FIG. 3, an exploded perspective view is provided that illustrates an embodiment of modular barrier device 100, for partitioning a room 101. A plurality of storage modules 110, and a door module 115, are shown assembled together in a portion of a room 101. Door rail 130, barn-style doors 140 with locking mechanism 142, storage doors 111, header fascia 162, to cover a gap 167 are shown in exploded view. Drop in ceiling 164, and void created 168, are shown with expandable filler 166, to fill the void 168, and fill the gap 167, are also shown in exploded view. Shelves 112, cubby 114, a basket 116, drawers 118 are also shown in this view.

Figure 4A:
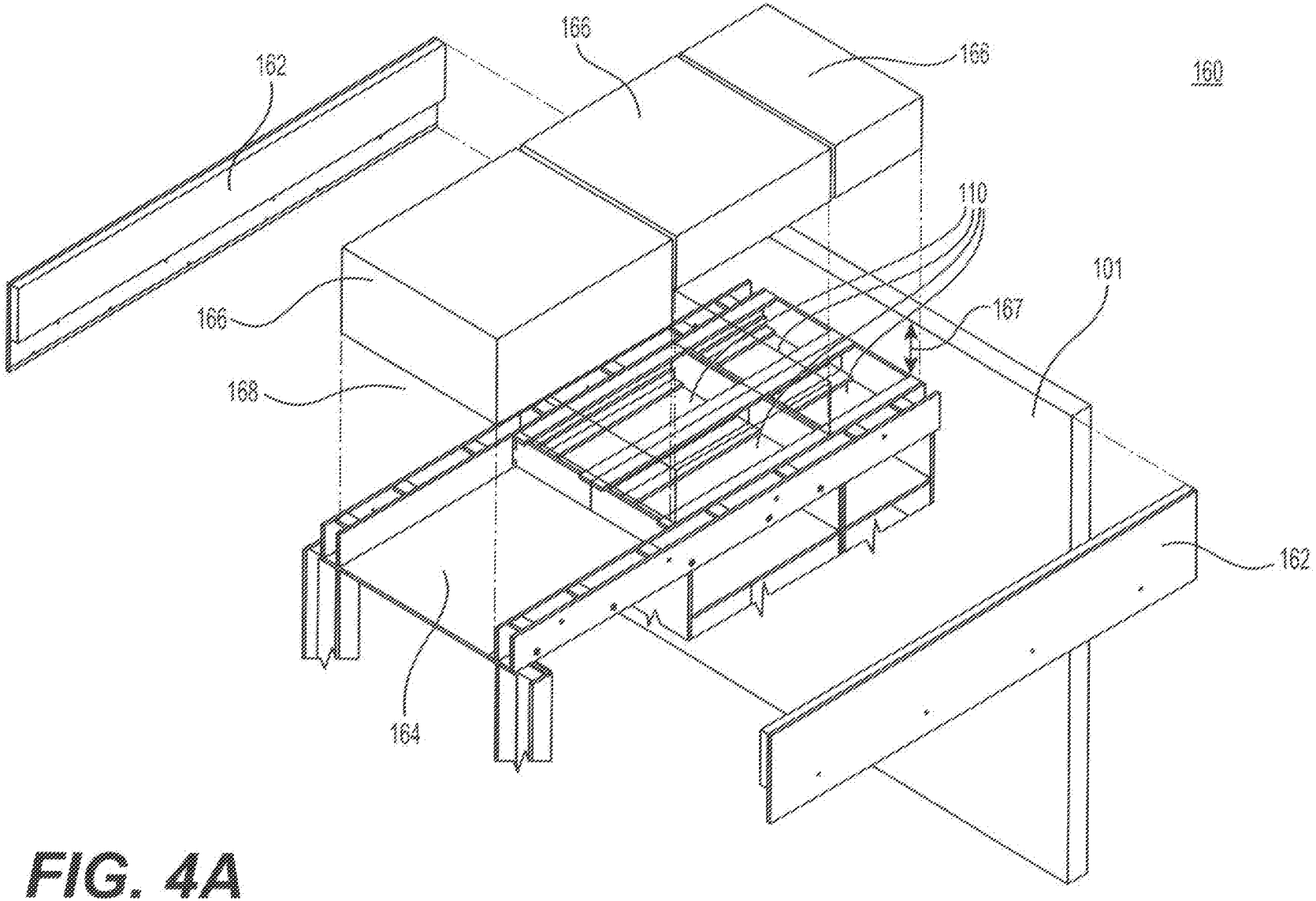
FIG. 4A is an exploded perspective view of an adjustable valance system of a modular barrier device for partitioning a room into two separate living spaces according to an embodiment.

Turning now to FIG. 4A, an exploded perspective view is provided that illustrates an adjustable valance system 160, in a room 101. The adjustable valance system 160, includes fascia boards 162, to cover a gap 167, drop in ceiling 164, and expandable tiller 166 to fill a cavity 168, and the gap 167.

Figure 4B:
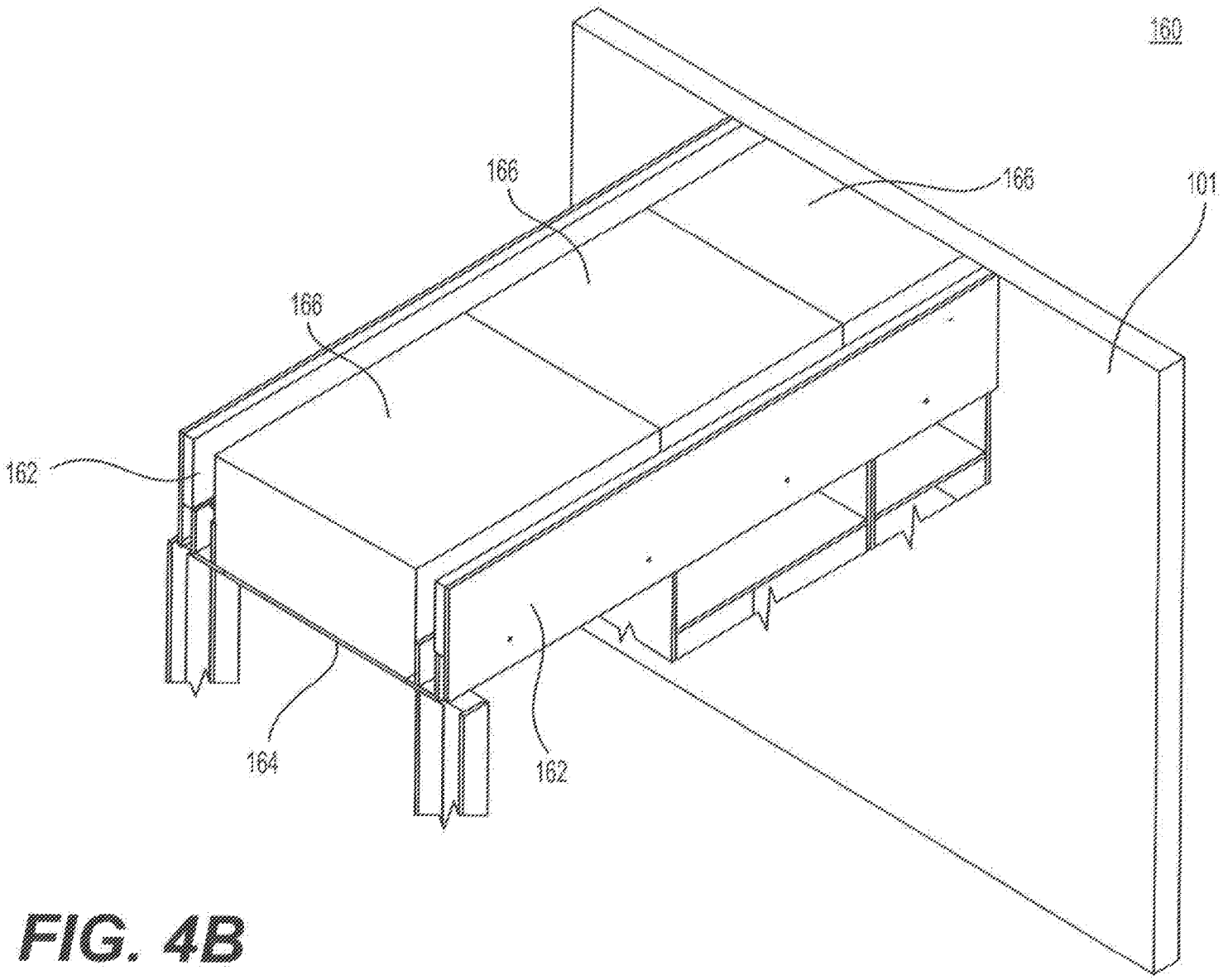
FIG. 4B is an assembled perspective view of an adjustable valance system of a modular barrier device for partitioning a room into two separate living spaces according to an embodiment.

Turning now to FIG. 4B, an assembled perspective view is provided that illustrates an adjustable valance system 160, in a room 101. The adjustable valance system 160, includes fascia boards 162, drop in ceiling 164, and expandable filler 166, to fill a cavity 168, and a gap 167.

Figure 5:
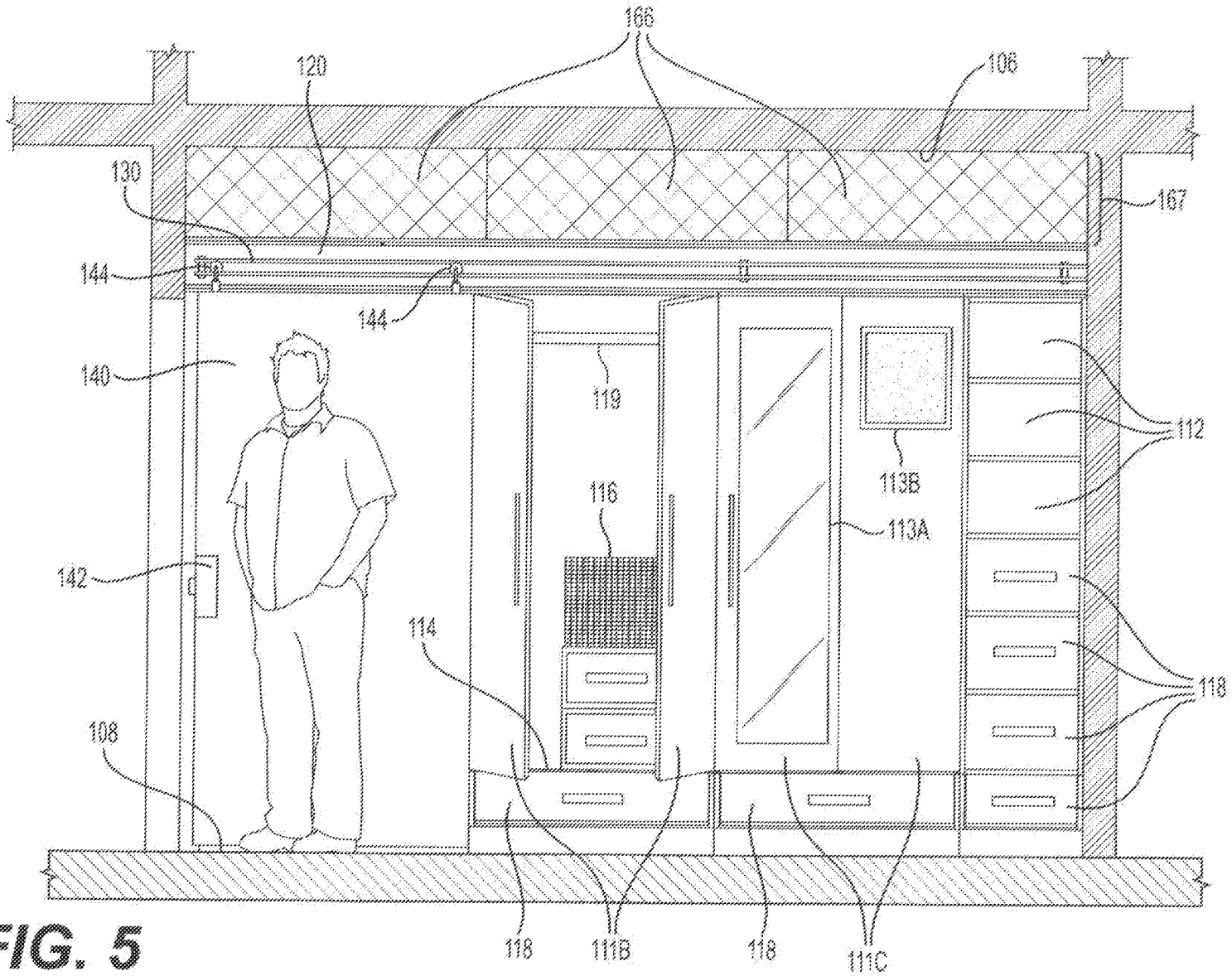
FIG. 5 is a side view of a modular barrier device for partitioning a room into two separate living spaces according to an embodiment.

Turning now to FIG. 5 aside view of a closet module 120, is shown positioned between room floor 108, and room ceiling 106, according to an embodiment. Expandable filler 166, filling a gap 167, between the closet module 120, and the room ceiling 106, are shown. Door rail 130, and burn-style door 140 with locking mechanism 142 and spring-loaded wheels 144, attached to the closet module 120, are also shown. Shelves 112, cubby 114, basket 116, drawers 118, and closet rod 119, are shown in the closet module 120. Hinged storage doors 111B and bi-fold storage door 111C, are also shown attached to the closet module 120. Hinged storage doors 111B and bi-fold storage door 111C as shown can be composed of metal, wood, medium density fiberboard, laminate, slats, glass, fabric or other suitable material. Storage door mirror covering 113A, and a storage door corkboard covering 113B, are shown on bi-fold storage door 111C as an example.

Figure 6:
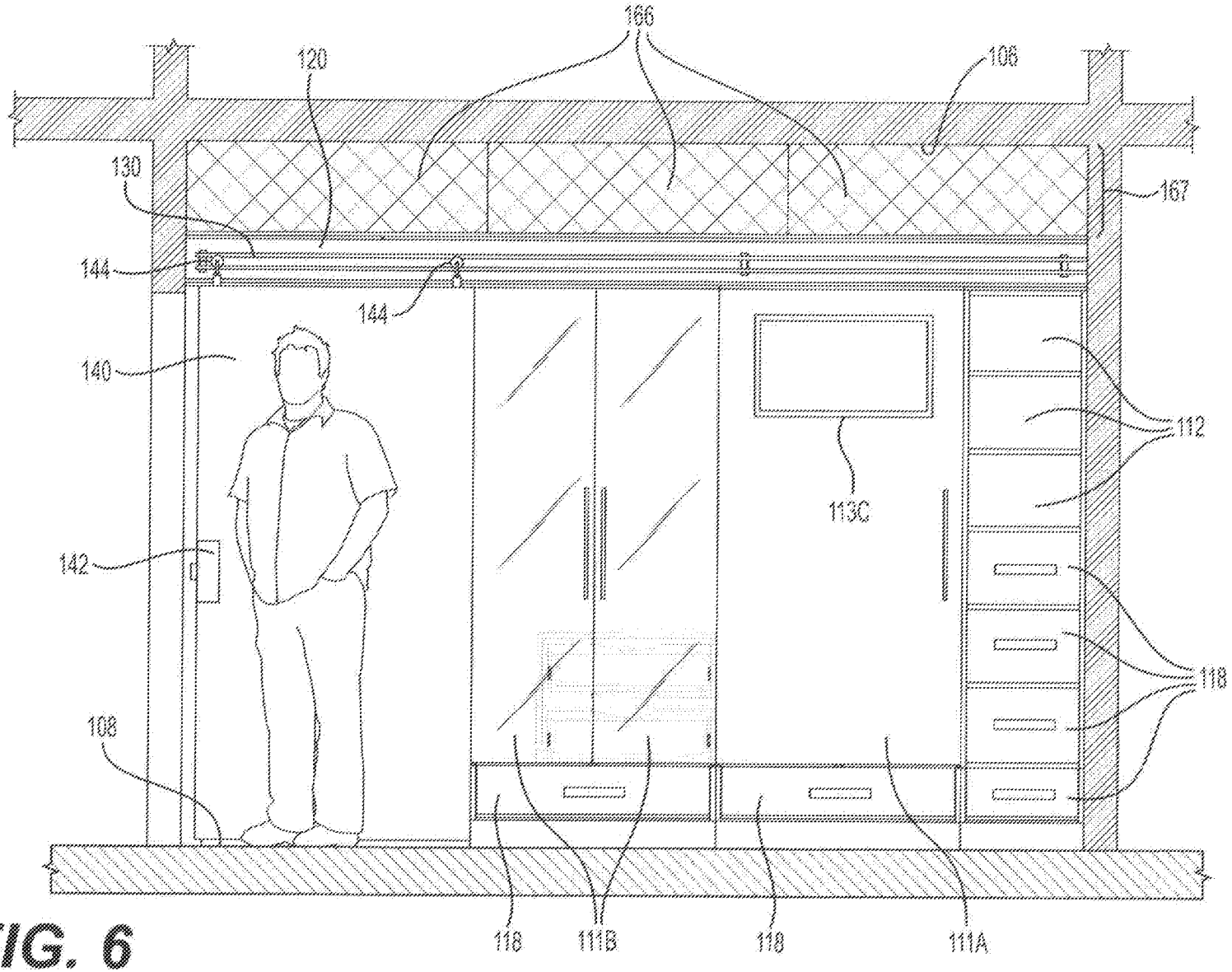
FIG. 6 is a side view of a modular barrier device for partitioning a room into two separate living spaces according to an embodiment.

Turning now to FIG. 6 a side view of a closet module 120, is shown positioned between room floor 108, and room ceiling 106, according to an embodiment. Expandable filler 166, filling a gap 167, between the closet module 120, and the room ceiling 106, are shown. Door rail 130, and barn-style door 140 with locking mechanism 142 and spring-loaded wheels 144, attached to the closet module 120, are also shown. Shelves 112, and drawers 118, are shown in the closet module 120. Sliding storage door 111A, and hinged storage doors 111B, are also shown attached to the closet module 120. Sliding storage door 111A, and hinged storage doors 111B, as shown can be composed metal, wood medium density fiberboard, laminate, slats, glass, fabric or other suitable material. Hinged storage door 111B, is shown composed of glass as an example. Storage door dry-erase board covering 113C, is shown on sliding storage door 111A, as an example.

Figure 7:
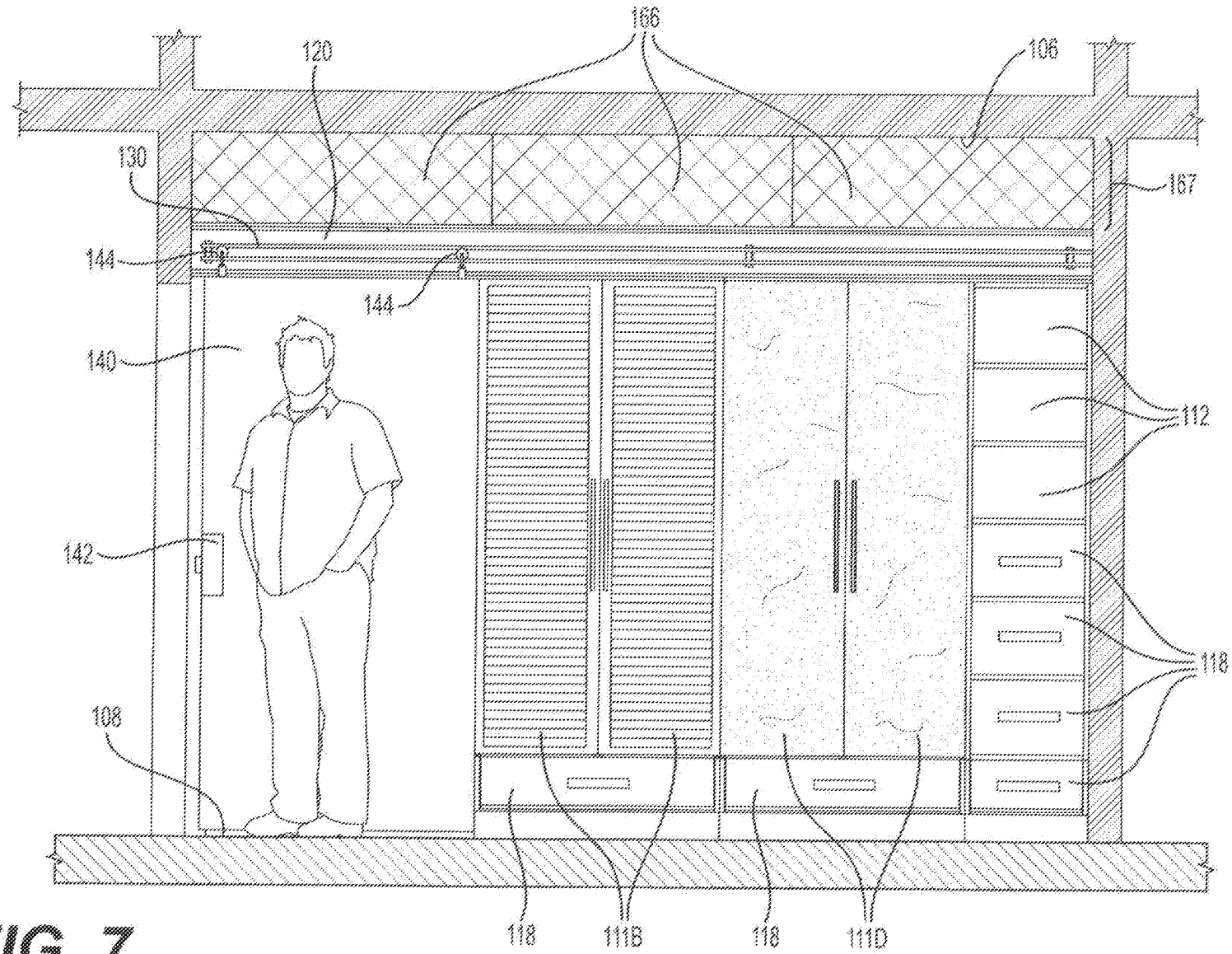
FIG. 7 is a side view of a modular barrier device for partitioning a room into two separate living spaces according to an embodiment.

Turning now to FIG. 7 a side view of a closet module 120, is shown positioned between room floor 108, and room ceiling 106, according to an embodiment. Expandable filler 166, filling a gap 167, between the closet module 120, and the room ceiling 106, are shown. Door rail 130, and barn-style door 140 with locking mechanism 142 and spring-loaded wheels 144, attached to the closet module 120, are also shown. Shelves 112, and drawers 118, are shown in the closet module 120. Hinged storage doors 111B, and fabric storage doors 111D, are also shown attached to the closet module 120. Hinged storage doors 111B, as shown can be composed metal, wood, medium density fiberboard, laminate, slats, glass, fabric or other suitable material. Hinged storage door 111B, is shown composed of slats as an example.

Figure 8:
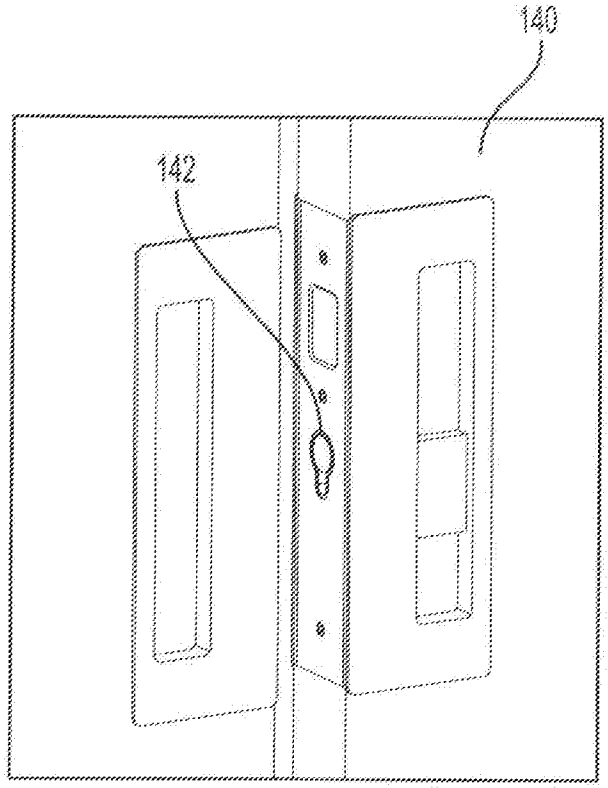
FIG. 8 is a perspective view of a locking mechanism according to an embodiment.

Turning now to FIG. 8 a perspective view of an exemplary locking mechanism 142, for a barn-style door 140, is shown.

Figure 9:
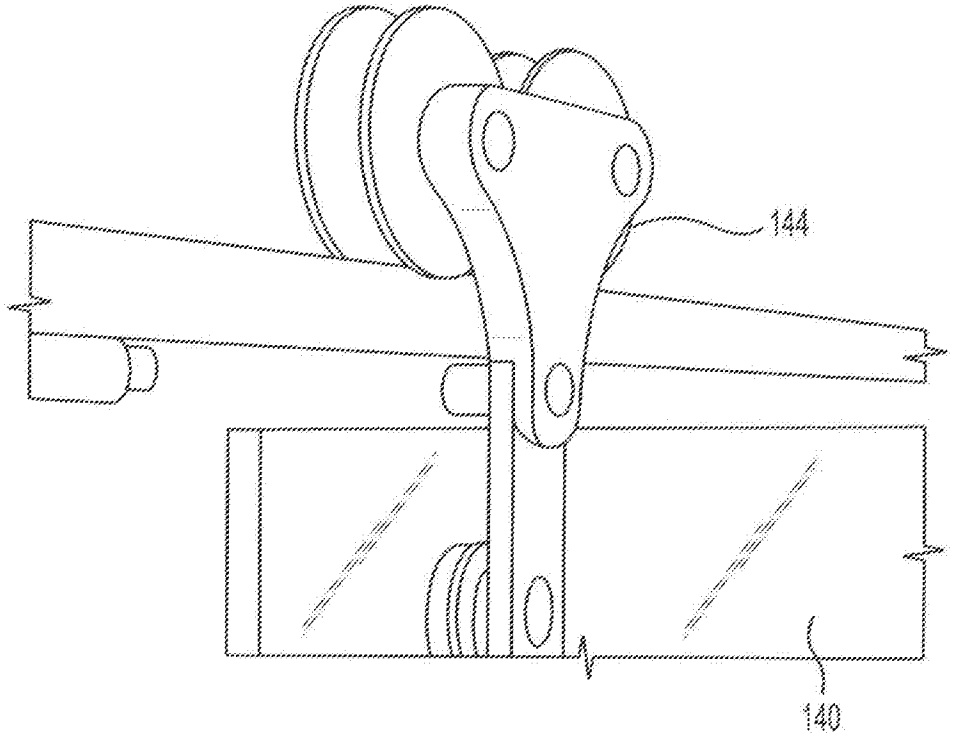
FIG. 9 is a perspective view of a spring-loaded wheel according to an embodiment.

Turning now to FIG. 9 a perspective view of an exemplary spring-loaded wheel 144, for a barn-style door 140, is shown.

Turning now to FIGS. 1-9 together, various views are provided that illustrate various aspects of an embodiment of a modular barrier device 100 for partitioning a room 101 into two separate living spaces 102, 104 comprising: a plurality of storage modules 110, said storage modules 110 arranged in a side-by-side as a well as a back-to-back fashion, and adjacent to a door module 115, to create a closet module 120 to define the two separate living spaces 102, 104 in the room 101; at least one door rail 130 attached to the closet module 120; at least one barn-style door 140 slidably attached to the at least one door rail 130 to provide user access to at least one of the two separate living spaces 102, 104; and an adjustable valence system 160, said adjustable valence system 160 capable of attaching to the closet module 120 and further capable of expanding to till any gap 167 between the top of the closet module 120 and a room ceiling 106 in the room 101.

In some embodiments, the modular barrier device 100 for partitioning a room 101 into two separate living spaces 102, 104, wherein the plurality of storage modules 110 further comprised of at least one shelf 112, cubby 114, basket 116, drawer 118 or closet rod 119.

In other embodiments, the modular barrier device 100 for partitioning a room 101 into two separate living spaces 102, 104, wherein the plurality of storage modules 110 further comprised of at least one storage door 111 to enclose at least a portion of the storage modules 110.

In still other embodiments, the modular barrier device 100 for partitioning a room 101 into two separate living spaces 102, 104, wherein the at least one storage door 111 further comprises at least one storage sliding door 111A, storage hinged door 111B, storage bi-fold door 111C or storage fabric door 111D.

In yet still other embodiments, the modular barrier device 100 for partitioning a room 101 into two separate living spaces 102, 104, wherein the at least one storage door 111 is composed of metal, wood, medium density fiberboard, laminate, glass, or slats.

In yet some other embodiments, the modular barrier device 100 for partitioning a room 101 into two separate living spaces 102, 104, wherein the at least one storage door 11 further comprises at least one storage door covering composed of a storage door mirror covering 113A, a storage door corkboard covering 113B, or a storage door dry-erase board covering 113C.

In various embodiments, the modular barrier device 100 for partitioning a room 101 into two separate living spaces 102, 104 of claim 1, wherein the barn-style door 140 slidably attached to the door rail 130 to provide user access to at least one of the two separate living spaces 102, 104 further comprises a locking mechanism 142.

In various other embodiments, the modular barrier device 100 for partitioning a room 101 into two separate living spaces 102, 104 of claim 7, wherein the locking mechanism 142 further comprises a magnetic lock.

In yet various other embodiments, the modular barrier device 100 for partitioning a room 101 into two separate living spaces 102, 104, wherein the barn-style door 140 slidably attached to the door rail 130 to provide user access to at least one of the two separate living spaces 102, 104 further comprises at least one spring-loaded wheel 144 attached to the barn-style door to provide stability for the barn-style door 140 when the barn style door 140 is slid open or closed across an uneven room floor 108.

In some embodiments, the modular barrier device 100 for partitioning a room 101 into two separate living spaces 102, 104, wherein the adjustable valence system 160 further comprises a header fascia 162 to cover any gap 167 between the top of the primary room partition 150 and the room ceiling 106 in the room 101, a drop-in ceiling 164 over a common area 109 to reduce light and sound from the common area 109, and an expandable filler 166 to fill a cavity 168 defined by the closet module 120, the room ceiling 106 in the room 101, the drop-in ceiling 164 and the header fascia 162 to further reduce light and sound transmission from the common area 109 and between the two separate living spaces 102, 104.

Turning again to FIGS. 1-9 together, various views are provided that illustrate various aspects of an embodiment of a modular barrier device 100 for partitioning a room 101 into two separate living spaces 102, 104 comprising: a plurality of storage modules 110, said storage modules arranged in a side-by-side as well as a back-to-back fashion and adjacent to a door module 115 to create a closet module 120, to define the two separate living spaces 102, 104, in the room 101, wherein said plurality of storage modules 110 further consist of at least one shelf 112, cubby 14, basket 116, drawer 118 or closet rod 119; said plurality of storage modules 110 further consist of at least one storage door 111 to enclose at least a portion of the storage modules 110; a door rail 130 attached to the closet module 120; a barn-style door 140 slidably attached to the door rail 130 to provide user access to at least one of the two separate living spaces 102, 104; said barn-style door 140 further consists of a locking mechanism 142; said barn-style door 140 further consists of at least one spring-loaded wheel 144 attached to the barn-style door 140 to provide stability for the barn-style door 140 when the barn style door 140 is slid open or closed across an uneven room floor 108; an adjustable valence system 160, said adjustable valence system 160 capable of attaching to the closet module 120 and further capable of expanding to fill any gap 167 between the top of closet module 120 and a room ceiling 106 in the room 101; and said adjustable valence system 160 further consists of a header fascia 162 to fill any gap 167 between the top of the closet module 120 and the room ceiling 106 in the room 101, a drop-in ceiling 164 over a common area 109 to reduce light and sound from the common area 109, and an expandable filler 166 to fill a cavity 168 defined by the closet module 120, the room ceiling 106 in the room 101, the drop-in ceiling 164 and the header fascia 162 to further reduce light and sound transmission from the common area 109 and between the two separate living spaces 102, 104.

In some embodiments, the modular barrier device 100 for partitioning a room 101 into two separate living spaces 102, 104, wherein the at least one storage door 111 further comprises at least one storage sliding door 111A, storage hinged door 111B, storage bi-fold door 111C or storage fabric door 111D.

In other embodiments, the modular barrier device 100 for partitioning a room 101 into two separate living spaces 102, 104, wherein the at least one storage door 111 is composed of metal, wood, medium density fiberboard, laminate, glass, or slats.

In still other embodiments, the modular barrier device 100 for partitioning a room 101 into two separate living spaces 102, 104, wherein the at least one door 111 further comprises at least one storage door covering composed of a storage door mirror covering 113A, a storage door corkboard covering 113B, or a storage door dry-erase board covering 113C.

In yet still other embodiments, the modular barrier device 100 for partitioning a room 101 into two separate living spaces 102, 104, wherein the locking mechanism 142 further comprises a magnetic lock.

Turning once again to FIGS. 1-9 together, various views are provided that illustrate various aspects of an embodiment of a modular barrier device 100 for partitioning a room 101 into two separate living spaces 102, 104 comprising: a plurality of storage modules 110, said storage modules 110 arranged in a side-by-side as well as a back-to-back fashion and adjacent to a door module 115 to create a closet module 120, to define the two separate living spaces 102, 104, in the room 101, wherein said plurality of storage modules 110 further consist of at least one shelf 112, cubby 114, basket 116, drawer 118 or closet rod 119; said plurality of storage modules 110 further consist of at least one storage door 111 to enclose at least a portion of the storage cabinets 110; said at least one storage door 111 further consist of at least one storage sliding door 111A, storage hinged door 113, storage bi-fold door 111C or storage fabric door 111D; said at least one storage door 111 is composed of metal, wood, medium density fiberboard, laminate, glass, or slats; said at least one storage door further consists of at least one storage door covering composed of a storage door mirror covering 113A, a storage door corkboard covering 113B, or a storage door dry-erase board covering 113C; a door rail 130 attached to the closet module 120; a barn-style door 140 slidably attached to the door rail 130 to provide user access to at least one of the two separate living spaces 102, 104; said barn-style door 140 further consists of a locking mechanism 142; said locking mechanism 142 further consists of a magnetic lock; said barn-style door 140 further consists of at least one spring-loaded wheel 144 attached to the barn-style door 140 to provide stability for the barn-style door 140 when the barn style door 140 is slid open or closed across an uneven room floor 108; an adjustable valence system 160, said adjustable valence system 160 capable of attaching to the closet module 120 and further capable of expanding to fill any gap 167 between the top of the closet module 120 and a room ceiling 106 in the room 101; and said adjustable valence system 160 further consists of a header fascia 162 to fill any gap 167 between the top of the closet module 120 and the room ceiling 106 in the room 101, a drop-in ceiling 164 over a common area 109 to reduce light and sound from the common area 109, and an expandable filler 166 to fill a cavity 168 defined by the closet module 120, the room ceiling 106 in the room 101, the drop-in ceiling 164 and the header fascia 162 to further reduce light and sound transmission from the common area 109 and between the two separate living spaces 102, 104.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc, are used to identify one element from another, and unless otherwise specified are not meant to refer to a particular order or number of elements.

A used herein, the terms "may" and "may be" indicate a possibility of an occurrence within a set of circumstances; a possession of a specified property, characteristic or function; and/or quality another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A modular barrier device for partitioning a room into two separate living spaces comprising:

a plurality of rectangular storage modules each defined by four walls, said storage modules arranged in a side-by-side as well as a back-to-back fashion and adjacent to a door module to create a closet module to define the two separate living spaces in the room;

at least one door rail attached to the closet module;

at least one barn-style door slidably attached to the at least one door rail to provide user access to at least one of the two separate living spaces; and an adjustable valence system, said adjustable valence system capable of attaching to the closet module and further capable of expanding to fill any gap between the top of the closet module and a room ceiling in the room.

2. The modular barrier device for partitioning a room into two separate living spaces of claim 1, wherein the plurality of rectangular storage modules further comprises at least one of a shelf, a cubby, a basket, a drawer or a closet rod.

3. The modular barrier device for partitioning a room into two separate living spaces of claim 1, wherein the plurality of rectangular storage modules further comprises at least one storage door to enclose at least a portion of the rectangular storage modules.

4. The modular barrier device for partitioning a room into two separate living spaces of claim 3, wherein the at least one storage door further comprises at least one storage sliding door, storage hinged door, storage bi-fold door or storage fabric door.

5. The modular barrier device for partitioning a room into two separate living spaces of claim 4, wherein the at least one storage door is composed of metal, wood, medium density fiberboard, laminate, glass, or slats.

6. The modular barrier device for partitioning a room into two separate living spaces of claim 3, wherein the at least one storage door further comprises at least one storage door covering composed of a storage door mirror covering, a storage door corkboard covering, or a storage door dry-erase board covering.

7. The modular barrier device for partitioning a room into two separate living spaces of claim 1, wherein the barn-style door slidably attached to the door rail to provide user access to at least one of the two separate living spaces further comprises a locking mechanism.

8. The modular barrier device for partitioning a room into two separate living spaces of claim 7, wherein the locking mechanism further comprises a magnetic lock.

9. The modular barrier device for partitioning a room into two separate living spaces of claim 1, wherein the barn-style door slidably attached to the door rail to provide user access to at least one of the two separate living spaces further comprises at least one spring-loaded wheel attached to the barn-style door to provide stability for the barn-style door when the barn style door is slid open or closed across an uneven room floor.

10. The modular barrier device for partitioning a room into two separate living spaces of claim 1, wherein the adjustable valence system further comprises a header fascia to cover any gap between the top of the primary room partition and the room ceiling in the room, a drop-in ceiling over a common area to reduce light and sound from the common area, and an expandable filler to fill a cavity defined by the closet module, the room ceiling in the room, the drop-in ceiling and the header fascia to further reduce light and sound transmission from the common area and between the two separate living spaces.

11. A modular barrier device for partitioning a room into two separate living spaces comprising:

a plurality of storage modules, said storage modules arranged in a side-by-side as well as a back-to-back fashion and adjacent to a door module to create a closet module to define the two separate living spaces in the room, wherein said plurality of storage modules further consist of at least one of a shelf, a cubby, a basket, a drawer or a closet rod;

said plurality of storage modules further consist of at least one storage door to enclose at least a portion of the storage modules;

a door rail attached to the closet module;

a barn-style door slidably attached to the door rail to provide user access to at least one of the two separate living spaces;

said barn-style door further consists of a locking mechanism;

said barn-style door further consists of at least one spring-loaded wheel attached to the barn-style door to provide stability for the barn-style door when the barn style door is slid open or closed across an uneven room floor; and an adjustable valence system, said adjustable valence system capable of attaching to the closet module and further capable of expanding to fill any gap between the top of the closet module and a room ceiling in the room;

said adjustable valence system further consists of a header fascia to fill any gap between the top of the closet module and the room ceiling in the room, a drop-in ceiling over a common area to reduce light and sound from the common area, and an expandable filler to fill a cavity defined by the closet module, the room ceiling in the room, the drop-in ceiling and the header fascia to further reduce light and sound transmission from the common area and between the two separate living spaces.

12. The modular barrier device for partitioning a room into two separate living spaces of claim 11, wherein the at least one storage door further comprises at least one storage sliding door, storage hinged door, storage bi-fold door or storage fabric door.

13. The modular barrier device for partitioning a room into two separate living spaces of claim 12, wherein the at least one storage door is composed of metal, wood, medium density fiberboard, laminate, glass, or slats.

14. The modular barrier device for partitioning a room into two separate living spaces of claim 11, wherein the at least one door further comprises at least one storage door covering composed of a storage door mirror covering, a storage door corkboard covering, or a storage door dry-erase board covering.

15. The modular barrier device for partitioning a room into two separate living spaces of claim 11, wherein the locking mechanism further comprises a magnetic lock.

16. A modular barrier device for partitioning a room into two separate living spaces comprising:

a plurality of storage modules, said storage modules arranged in a side-by-side as well as a back-to-back fashion and adjacent to a door module to create a closet module to define the two separate living spaces in the room, wherein said plurality of storage modules further consist of at least one of a shelf, a cubby, a basket, a drawer or a closet rod;

said plurality of storage modules further consist of at least one storage door to enclose at least a portion of the storage cabinets;

said at least one storage door further consists of at least one storage sliding door, storage hinged door, storage bi-fold door or storage fabric door;

said at least one storage door is composed of metal, wood, medium density fiberboard, laminate, glass, or slats;

said at least one storage door further consists of at least one storage door covering composed of a storage door mirror covering, a storage door corkboard covering, or a storage door dry-erase board covering;

a door rail attached to the closet module;

a barn-style door slidably attached to the door rail to provide user access to at least one of the two separate living spaces;

said barn-style door further consists of a locking mechanism;

said locking mechanism further consists of a magnetic lock;

said barn-style door further consists of at least one spring-loaded wheel attached to the barn-style door to provide stability for the barn-style door when the barn style door is slid open or closed across an uneven room floor; and an adjustable valence system, said adjustable valence system capable of attaching to the closet module and further capable of expanding to fill any gap between the top of the closet module and a room ceiling in the room;

said adjustable valence system further consists of a header fascia to fill any gap between the top of the closet module and the room ceiling in the room, a drop-in ceiling over a common area to reduce light and sound from the common area, and an expandable filler to fill a cavity defined by the closet module, the room ceiling in the room, the drop-in ceiling and the header fascia to further reduce light and sound transmission from the common area and between the two separate living spaces.

* * * * *